United States Patent [19]

Maitrepierre et al.

[11] Patent Number: 4,474,627

[45] Date of Patent: Oct. 2, 1984

[54] METHOD OF MANUFACTURING STEEL BARS AND TUBES WITH GOOD MECHANICAL CHARACTERISTICS

[75] Inventors: Philippe Maitrepierre; Bernard Heritier, both of Albertville; Jaime Rofes-Vernis; Alain Wyckaert, both of St.Mitre-les-Remparts, all of France

[73] Assignee: Ugine Aciers, Puteaux, France

[21] Appl. No.: 442,661

[22] Filed: Nov. 18, 1982

[30] Foreign Application Priority Data

Apr. 22, 1982 [FR] France ..... 82 07281

[51] Int. Cl.[3] ..... C21D 8/10

[52] U.S. Cl. ..... 148/12 B; 148/36

[58] Field of Search ..... 148/36, 12 F, 12 B, 148/12 R, 12.4, 12.3; 75/123 J, 123 B, 123 G, 124 B, 126 P, 126 G, 128 V; 72/201

[56] References Cited

U.S. PATENT DOCUMENTS

| | | | |
|---|---|---|---|
| 2,513,240 | 6/1950 | Hill | 75/123 G |
| 3,926,687 | 12/1975 | Gondo et al. | 148/12 B |
| 4,075,041 | 2/1978 | Ueno et al. | 148/12.4 |
| 4,219,371 | 8/1980 | Nakasugi et al. | 148/12 F |
| 4,354,882 | 10/1982 | Greer | 148/36 |
| 4,370,178 | 1/1983 | Waid et al. | 148/36 |

FOREIGN PATENT DOCUMENTS

| | | | |
|---|---|---|---|
| 53-75114 | 7/1978 | Japan | 148/36 |
| 53-97922 | 8/1978 | Japan | 148/12 F |
| 55-107726 | 8/1980 | Japan | 75/124 B |
| 55-122854 | 9/1980 | Japan | 75/124 B |
| 56-166324 | 12/1981 | Japan | 148/12 R |
| 57-23047 | 2/1982 | Japan | 75/126 G |

OTHER PUBLICATIONS

Steel Specialty Tubular Products, Steel Products Manual, American Iron & Steel Institute, NY, NY, Feb. 1972, pp. 15–18.

Pickering, "High-Strength, Low-Alloy Steels-A Decade of Progress," Micro Alloying 75, Session 1, Conf. Wash. D.C., Oct. 1975, pp. 3–24.

*Primary Examiner*—Peter K. Skiff

*Attorney, Agent, or Firm*—Oblon, Fisher, Spivak, McClelland & Maier

[57] ABSTRACT

The invention relates to a method of making steel bars and tubes with good mechanical characteristics.

The process consists of manufacturing a low alloy steel containing 0.06 to 0.12% carbon as well as additions with well-determined contents of Si, Mn, Nb, Al, B and optionally V. The steel is used in a raw state of hot rolling, optionally followed by tempering.

The bars and tubes obtained in this manner are used for applications in which it is necessary to have a high elastic limit associated with high resistance.

10 Claims, No Drawings

METHOD OF MANUFACTURING STEEL BARS AND TUBES WITH GOOD MECHANICAL CHARACTERISTICS

BACKGROUND OF THE INVENTION

1. Field of the Invention:

The method of the invention relates to a new method for manufacturing bars and tubes made of low alloy steel with good mechanical characteristics in the raw state of hot transformation, whereby the elastic limit, the rupture load and the resilience are particularly good. The method also significantly lowers the cost of transforming steel into bars or tubes with good mechanical characteristics.

The invention also relates to bars and tubes with good mechanical characteristics in the raw state of hot rolling as a result of the combination of a composition defined within a precise range and of a predominantly bainitic structure.

More precisely speaking, the invention relates to bars or tubes with mechanical characteristics which are at least equal to the minimum characteristics of grade N80 of the American Petroleum Institute, obtained by a method of manufacturing and transforming which is much more economical than the methods customarily used.

2. Description of the Prior Art:

The customary methods of manufacturing bars or tubes with mechanical characteristics corresponding to grade N80 of the American Petroleum Institute consist of manufacturing a low alloy steel such as the steel according to norm AFNOR 40MD7. The steel contains in % by mass: C 0.25 to 0.50, Mn 1.20 to 1.70, Mo 0.20 and the customary impurities. After having been casted into ingots or bars in a continuous casting, this steel is transformed by hot rolling into bars of the desired section, e.g. round bars 100 to 200 mm in diameter. In a raw state of hot rolling these bars generally have an elastic limit of approximately 750 MPa, but a low resilience below 30 Joules/cm$^2$ measured in KCU test pieces.

In order to impart the desired mechanical characteristics to them, they are then subjected to a thermal treatment comprising an austenitizing tempering at a temperature of approximately 875° C. followed by an air cooling approximately down to the ambient temperature and finally tempering at a temperature of approximately 600° to 650° C.

The bars obtained in this manner have mechanical characteristics in conformity with grade N80, namely:

rupture load R≧700 MPa (71.4 kg/mm$^2$)

elastic limit E≧550 MPa (56.1 kg/mm$^2$)

resilience KCU≧80 J/cm$^2$ (U.S. equivalent toughness≧4,570 lb/in$^2$).

These thermal treatment operations after rolling are costly as regards manufacturing time, handling and checking as well as thermal energy and require, in addition, large, specialized equipment for performing such treatments.

Research was performed to develop a method of manufacture and of transformation applied to a particular composition of steel which would permit the obtention of bars in a raw state of hot rolling which directly offer the mechanical characteristics required by the users. Research was also performed to make tubes from these bars by cold piercing, then hot rolling on a mandrel, which have mechanical characteristics in the raw state of hot rolling which are comparable to those of these bars.

Research was performed in particular to obtain bars or tubes with an elastic limit E over 550 MPa (56.1 kg/mm$^2$ )associated with a KCU resilience over 80 J/cm$^2$ U.S. equivalent toughness ≧4,570 lb/in$^2$ in a raw state of hot rolling.

The idea was conceived in accordance with the invention of producing a steel with the following composition in % by mass: C 0.060 to 0.120 and preferably 0.080 to 0.110, Si 0.30 to 0.70, Mn 1.30 to 2.00 and preferably 1.50 to 1.80, Nb 0.050 to 0.120, B 0.0025 to 0.0060, Al 0.040 to 0.080, N≧0.010, remainder Fe and customary impurities. This steel, which is usually produced from scrap iron, can contain fairly numerous metallic impurities such as Ni, Cr, Cu and Mo, whereby the total amount of metallic impurities does not exceed approximately 1%. An optional addition of V up to 0.12% can likewise be made. It can also include an addition of S up to a content of approximately 0.040 to 0.070% to improve the suitability for machining. This addition can be combined with very small additions of alkaline-earth metals such as Ca and/or Mg, and/or of rare earth metals to improve the isotropy of the mechanical characteristics.

After it has been casted in the form of ingots or of bars in a continuous casting, the steel is transformed under controlled conditions. The blooming of the ingots is performed in a classic manner at a temperature of approximately 1200° to 1050° C. The bars obtained in this manner or the continuous casting bars undergo a controlled rolling at a temperature between 1000° and 700° C. in a single heat until the obtention of circular or non-circular bars with the desired section. In the case of rolling tubes, the raw, hot-rolled bar is pierced by hot-piercing, then, the tube blank obtained is hot-rolled on a mandrel until the desired size. It can be advantageous both for bars and for tubes to perform a tempering step which allows the precipitation of the Nb to be completed and the main benefit of which is to raise the elasticity limit. This tempering is preferably performed at a temperature between 550° and 700° C.

The good mechanical characteristics of the products obtained by the method of the invention basically result from the effect of the hot rolling operation performed within defined temperature limits and with a well-determined rolling rate on a steel whose composition is within the limits specified above. Due to its low carbon content associated with a well-defined manganese content and a combination of additions of niobium, boron and aluminum in critical proportions, it is possible to eliminate the classic treatments, which were considered obligatory to obtain these particular mechanical characteristics.

The following non-limiting example describes a manner of accomplishing the method of the invention.

A steel is produced which contains in % by mass: C 0.085, Si 0.452, Mn 1.520, Nb 0.060, Al 0.071, B 0.0049, N 0.007, Ni 0.136, Cr 0.167, Cu 0.228, S 0.028, P 0.017, remainder Fe and customary impurities.

This steel is cast in ingots of 5.8 tons. These ingots are preheated to 1230° C., then bloomed into bars of 182×182 mm at a temperature between 1200° and 1050° C., then rolled in a continuous process into round bars 140 mm in diameter. The entry temperature is approximately 950° C. and the temperature at the exit of the last housing of the rolling mill is approximately 710° C. Specimens 10 mm in diameter are taken from these raw, hot-rolled bars for traction tests as well as specimens for resilience measurements of the KCU long direction type. These samples are taken at 25 mm from the surface (axis of the sample $\phi$ 10 mm located 25 mm below this surface).

The following table gives the mechanical characteristics obtained:

| elasticity limit E MPa | rupture load R MPa | elong-ation A % | contraction of cross section Z % | resilience KCU J/cm$^2$ |
|---|---|---|---|---|
| 600 (61.2 kg/mm$^2$) | 680 (69.4 kg/mm$^2$) | 24 | 53 | 90 |

It can be seen that the elastic limit is over 550 MPa and that the resilience is over 80 J/cm. Moreover, micrographic examinations show that the structure of the bar is homogeneous and predominantly bainitic at all points. It is also possible to use the method of the invention to make bars with a section other than circular, such as square or rectangular bars or bars with any section. In all instances the rolling operation which is used to obtain these bars must be performed at a temperature between 1000° and 700° C. and the rolling rate should preferably reach at least 50% without intermediate reheating.

As has already been described above, it is possible to increase the elastic limit of the raw, hot-rolled bars even more by subjecting them to tempering at a temperature which is preferably between 550° and 700° C.

What is claimed as new and desired to be secured by letters patent of the United States is:

1. A method of producing steel bars or tubes with a predominantly fine bainitic structure, an elastic limit over 550 MPa (U.S. equivalent 56.1 kg/mm$^2$) and a resilience over 80 J/cm$^2$ (U.S. equivalent 4,570 lb/in$^2$) in the raw state of hot rolling which comprises the steps of:

manufacturing a steel containing in % by mass:

C 0.060 to 0.120,
Si 0.30 to 0.70,
Mn 1.30 to 2.00,
Nb 0.050 to 0.120,
B 0.0025 to 0.0060,
Al 0.040 to 0.080,
N<0.010,
V<0.120,
customary impurities, among which the total of the metallic impurities such as Ni, Cr, Cu, Mo does not exceed 1.0,
remainder Fe;

hot transforming said steel with a final controlled rolling in the form of bars at a temperature between about 1000° and 700° C. in a single heat with a reduction rate of the initial section of at least 50%.

2. The method according to claim 1, in which the steel contains in % by mass: C 0.080 to 0.110 and Mn 1.50 to 1.80

3. The method according to claim 1 or 2 in which the steel contains in % by mass: V0.060 to 0.120.

4. The method according to claim 1 or 2, in which the steel further contains in % by mass S 0.040 to 0.070% and at least one metal selected from the group consisting of the alkaline-earth metals and the rare earth metals.

5. The method according to claim 1, in which the bars obtained by hot rolling are then hot-pierced, then hot-rolled on a mandrel into the form of tubes.

6. The method according to claim 1 or 5, in which the hot rolled bars or tubes undergo tempering at a temperature between 550° and 700° C.

7. Steel bars or tubes with a predominantly fine-grain bainitic structure, an elastic limit 25 mm below the surface over 550 MPa (U.S. Equivalent 56.1 kg/mm$^2$) and a resilience over 80 J/cm$^2$ (U.S. equivalent toughness over 4,570 lb/in$^2$) which have the following composition in % by mass:

C 0.060 to 0.120,
Si 0.30 to 0.70,
Mn 1.30 to 2.00,
Nb 0.050 to 0.120,
Al 0.040 to 0.080,
B 0.0025 to 0.0060,
N$\leqq$0.010,
V$\leqq$0.120,
customary impurities, among which the total of metallic impurities such as Ni, Cr, Cu, Mo does not exceed 1.0,
remainder Fe.

8. The steel bars or tubes according to claim 7, containing in % by mass: C 0.080 to 0.110 and Mn 1.50 to 1.80.

9. The steel bars or tubes according to claim 7 or 8, containing in % by mass: V 0.060 to 0.120.

10. The steel bars or tubes according to claim 7 or 8, comprising an addition in % by mass of: S 0.040 to 0.070 and an addition of at least one metal from the group comprising the alkaline-earth metals and the rare earth metals.

* * * * *